US011584562B2

(12) United States Patent
Klein et al.

(10) Patent No.: US 11,584,562 B2
(45) Date of Patent: Feb. 21, 2023

(54) FOLDED CARDBOARD BOX

(71) Applicant: Braun GmbH, Kronberg (DE)

(72) Inventors: Heinrich Michael Klein, Niedernhausen (DE); Kieran Geiss, Sulzbach (DE)

(73) Assignee: Braun GmbH, Kronberg (DE)

( * ) Notice: Subject to any disclaimer, the term of this patent is extended or adjusted under 35 U.S.C. 154(b) by 88 days.

(21) Appl. No.: 16/776,143

(22) Filed: Jan. 29, 2020

(65) Prior Publication Data

US 2020/0239178 A1 Jul. 30, 2020

(30) Foreign Application Priority Data

Jan. 30, 2019 (EP) ..... 19154630
Nov. 27, 2019 (EP) ..... 19211972

(51) Int. Cl.
*B65D 5/06* (2006.01)
*B65D 5/08* (2006.01)
*B65D 5/42* (2006.01)

(52) U.S. Cl.
CPC ..... *B65D 5/062* (2013.01); *B65D 5/08* (2013.01); *B65D 5/4204* (2013.01); *B65D 5/4266* (2013.01)

(58) Field of Classification Search
CPC ..... B65D 5/062; B65D 5/08; B65D 5/4204; B65D 5/4266; B65D 5/5007; B65D 5/0245; B65D 75/368; A46B 15/0091; A47K 1/09

(Continued)

(56) References Cited

U.S. PATENT DOCUMENTS 2,749,019 A 6/1956 Wilfred
2,939,622 A 6/1960 Ippolito
(Continued)

FOREIGN PATENT DOCUMENTS

CN 201633981 U 11/2010
EP 2583906 4/2013
(Continued)

OTHER PUBLICATIONS

Extended European Search Report and Search Opinion; Application Ser. No. 19154630.8; dated Jun. 27, 2019; 6 pages.
(Continued)

*Primary Examiner* — Christopher R Demeree
(74) *Attorney, Agent, or Firm* — Vladimir Vitenberg

(57) ABSTRACT

A folded cardboard box has four longitudinal walls and a separation wall dividing the box's interior into first and second sections. The separation wall has a through-hole and a flap element at an open end of the first section. The flap element has a first flap portion at one of the longitudinal walls and a second flap portion at an adjoining longitudinal wall. The flap element can be flapped from a first state in which each of the first and second flap portions are aligned with the respective wall into a second state in which the flap element projects into the first section. A longitudinally extending wall portion, provided at one of the longitudinal walls at the open end of the first section, is connected, at its rear end, to the longitudinal wall at which it is provided by means of a seam line allowing bending of the wall from a first state in which it extends in longitudinal direction into a second state in which the wall projects from the longitudinal wall at which it is provided at about a right angle into the first section, so that the flap element, when in its second state, keeps the wall portion in its second state.

17 Claims, 6 Drawing Sheets

(58) Field of Classification Search
USPC ..... 206/485, 362.2, 362.1, 362.3, 471, 562, 206/780; 229/122, 125.26; 248/311.2; 53/456, 484
See application file for complete search history.

(56) References Cited

U.S. PATENT DOCUMENTS 2,983,429 A * 5/1961 Bergstein ..... B65D 5/4612 229/117.13
3,114,474 A * 12/1963 Davis ..... B65D 5/5445 221/92
4,511,042 A * 4/1985 Wischusen, III ..... B65D 5/064 206/562
4,696,402 A * 9/1987 Harmon ..... B65D 71/14 206/703
6,227,441 B1 * 5/2001 Sagel ..... B65D 5/5007 229/117.35
2005/0061860 A1 * 3/2005 Johnson ..... B65D 5/5035 229/120.011
2013/0001126 A1 1/2013 Gu
2016/0297560 A1 10/2016 Toth

FOREIGN PATENT DOCUMENTS

FR 2816916 A1 5/2002
FR 2816916 B1 2/2003
FR 3016612 7/2016
GB 203953 9/1923
JP H068933 A 1/1994
WO WO2017221514 12/2017

OTHER PUBLICATIONS

Extended European Search Report and Search Opinion; Application Ser. No. 19211972.5; dated Apr. 6, 2020; 7 pages.
International Search Report and Written Opinion; Application Ser. No. PCT/IB2020/050605; dated Feb. 28, 2020; 14 pages.

* cited by examiner 1G
102G
112G
63G
60G
61G
5G
40G
3G
20G
70G
111G
10G
50G
30G
101G
80G 102G
63G
60G
61G
803G
80G
801G
802G
l7
w7
112G
81G
101G 102G
802G
63G
60G
801G
803G
80G 3G
102G
10G
60G
61G
20G
63G
600G
80G
40G
5G
801G
30G

FOLDED CARDBOARD BOX

FIELD OF THE INVENTION

The present disclosure is generally concerned with a folded cardboard box for receiving an article, such, e.g., as an electric toothbrush.

BACKGROUND OF THE INVENTION

It is generally known that folded cardboard boxes are used for holding and transporting articles of various kinds. As cardboard is typically mainly made of renewable materials such as cellulose fibers. Further, a certain percentage of already used cardboard can be recycled for making new cardboard. Thus, cardboard boxes widely known as sustainable packaging have advantages over packaging that comprises a high percentage (up to 100%) of synthetic plastic material based on unsaturated hydrocarbons that come from limited natural resources of petroleum oil or petroleum gas. Therefore, there is a high need to replace packaging items that so far were made from e.g. foamed polystyrene or deep-drawn or thermoformed plastic foil by sustainable packaging made from renewable materials such a cellulose fiber. In particular in the production of mass products there is also a need for packaging that can be easily utilized in an automated packaging process, where an article is placed into such a sustainable package and is secured therein so that the article can survive drops or other impacts. Further, it should also be inhibited that the article falls out of the packaging during the automated packaging process.

It is an object of the present disclosure to provide a folded cardboard box that can be used in automated packaging of in particular articles that have a first portion that has a larger diameter and a second portion that has a smaller diameter (e.g. handles of electric toothbrushes).

SUMMARY OF THE DISCLOSURE

In accordance with an aspect of the present disclosure, a folded cardboard box for receiving at least one article is provided, the cardboard box comprising four longitudinal wall elements surrounding an essentially rectangular elongated interior and a separation wall that divides the elongated interior in longitudinal direction into a first interior box section and a second interior box section, wherein the separation wall comprises a through-hole, a flap element being provided at an open end of the first interior box section, which flap element has a first flap portion provided at one of the longitudinal wall elements and a second flap portion provided at an adjoining longitudinal wall element, which flap element can be flapped from a first state in which the first and second flap portions are each aligned with the respective wall element at which they are provided into a second state in which the flap element projects into the first interior box section, a longitudinally extending wall portion provided at one of the longitudinal wall elements at the open end of the first interior box section that is at its rear end connected to the longitudinal wall element at which it is provided by means of a seam line that allows bending of the wall portion from a first state in which it essentially extends in longitudinal direction into a second state in which the wall portion projects from the longitudinal wall element at which it is provided at about a right angle into the first interior box section, and wherein the flap element when in its second state keeps the wall portion in its second state.

In accordance with an aspect of the present disclosure, a method of automated packaging of a toothbrush is provided. The method includes steps of: providing the cardboard box in which the flap element is in its unflapped state; providing a toothbrush having a first portion having a first diameter fitting into the first interior box section and a second portion having a second diameter that is smaller than the first diameter; inserting the toothbrush into the first interior box section until the second portion of the toothbrush extends through the separation wall's trough-hole and the first portion abuts the separation wall; bending the wall portion from its first state into its second state so that the wall portion projects from the longitudinal wall element at which it is provided at about a right angle; and flapping the flap element from its first state into its second state so that the wall portion becomes arranged between an end of the toothbrush and the flap element, thereby securing the toothbrush inside the box.

BRIEF DESCRIPTION OF THE DRAWINGS

The present disclosure will be further elucidated by a detailed description of several exemplary embodiments of the cardboard and by reference to accompanying figures, wherein.

DETAILED DESCRIPTION OF THE INVENTION

Figure 1:
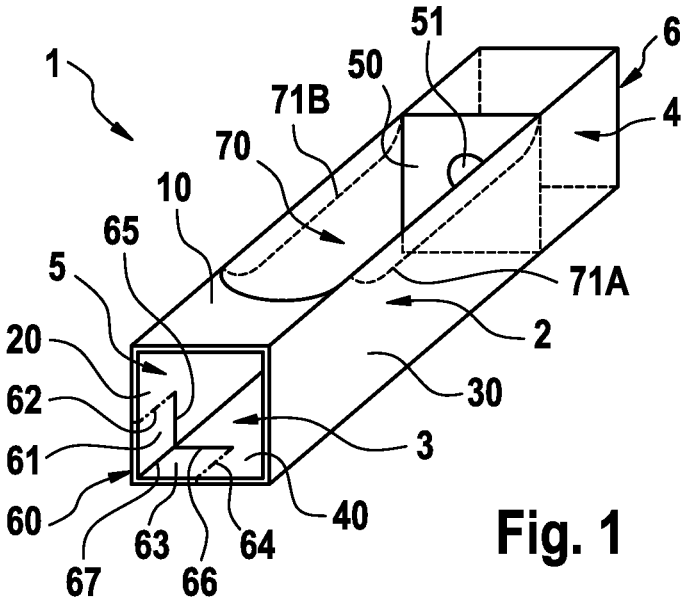
FIG. 1 is a schematic depiction of an exemplary embodiment of the cardboard box.

The term "cardboard" as used herein shall cover any type of heavy-duty paper products (i.e. heavy-duty cellulose fiber-based products) that range from paperboard to corrugated cardboard (also named corrugated fiberboard), where the latter is made from multiple corrugated layers and flat (i.e. paper) layers. In some embodiments, corrugated cardboard made from two flat outer layers and a corrugated middle layer is used. For the purposes of the present application, a paper product shall be considered as heavy-duty paper product when it has a specific area weight (DIN EN ISO 536) of at least about 160 g/m$^2$, in particular of at least about 200 g/m$^2$. Corrugated cardboard shall generally be considered as a heavy-duty paper product. Without being limited by theory, the type of the corrugated layer of the corrugated cardboard may be B, E, F or G (DIN 55468).

A cardboard may comprise several layers such as two outer layers and an inner layer, which layers are essentially inseparably connected. It shall be understood that where the term "layer" is used in the present description, it shall typically refer to (if nothing to the contrary is stated) a layer of a final cardboard material and not to a layer from which the cardboard is made. A folded cardboard box may be said to have a wall having two layers, which then means that two layers of final cardboard were connected to each other, e.g. by means of gluing. Cardboard material is commonly used for sustainable packaging as paper is a renewable resource as has already been explained in the background section.

A cardboard blank may be used to manufacture a folded cardboard box. A cardboard blank is typically made by cutting and stamping. The outer shape is generated by cutting off excess cardboard material. Cutting may also be used to produce cut lines between parts of the cardboard box that shall be moved separately from each other. Further cutting may be used to produce perforated lines.

A certain type of the perforation can be adapted to strength that shall be required to separate (or rip off) parts of the cardboard material from other parts. In addition, stamping may be used to generated weakened lines between parts of the cardboard blank, where the weakened lines function as a hinge to allow to easily move or bend a part of the cardboard blank around a predetermined pivot axis with respect to the other parts of the cardboard blank. In the design of cardboard boxes it is regularly desired to make a folded cardboard box from a single cardboard blank.

A folded cardboard box in accordance with the present description comprises longitudinal wall elements that enclose a box interior, where a separation wall in the folded cardboard box splits the box interior into a first interior box section and a second interior box section. The separation wall has a through-hole, which in particular has an elongated (i.e. non-circular) shape. While the number of longitudinal wall elements is not limited by theory, a usual number of the longitudinal wall elements may be three, four, or five.

The folded cardboard box also comprises a flap portion that is arranged at the open end of the first interior box section and which flap portion can be folded from a first state, in which it is aligned with the longitudinal wall section into a second state in which it is folded inwards and thus effectively avoids that an article that is disposed in the first interior box section can slide out of the box. A wall portion may be provided at an inner cardboard layer so that the wall portion is folded upwards once the flap portion is folded inwards.

The folded cardboard box may be made from a single cardboard blank. At least one of the longitudinal wall elements and/or the separation wall may comprise two or even more cardboard layers. The inner surface of the (inner) cardboard layer(s) may comprise a lacquering or coating having a low roughness.

Where in the following embodiments are shown in the figures and are discussed in the description that do not comprise a wall portion, it shall be understood that the figures and the respective description are for illustrative purposes only and that the cardboard box in accordance with the present description shall comprise a wall portion.

FIG. 1 is a schematic depiction of an exemplary folded cardboard box 1 for receiving an article, such e.g., as a toothbrush (not shown). Four longitudinally extending wall elements 10, 20, 30, 40 adjoin each other to form an essentially rectangular box having a rectangular interior. With respect to the schematic depiction, it is referred to the longitudinal wall element 10 as the top wall element, to the longitudinal wall elements 20 and 30 as the side wall elements (where here it may referred to wall element 20 as the left wall element and to wall element 30 as the right wall element) and to longitudinal wall element 40 as the bottom wall element. In the further description, the phrase "longitudinal" may be omitted when reference is made to a longitudinal wall element.

While box 1 in FIG. 1 is shown to have a continuous outer wall, it shall be understood that any folded cardboard box discussed herein may be made from a single cut and stamped cardboard blank and that thus at least one of the wall elements comprises a portion of overlapping cardboard material, i.e. where this portion may be referenced to as a two-layer cardboard portion.

The folded cardboard box 1 has a separation wall 50 that separates the interior 2 of the box into a first interior box section 3 and a second interior box section 4. The front side 5 of the first interior box section 3 may be open. The back side of the second interior box section 4 may be open or closed. The separation wall 50 has a through-hole 51 so that a small diameter portion of an article to be received in the interior 2 of the box 1 can extend through this through-hole 51.

The through-hole 51 is here shown to have a circular shape, even though the through-hole 51 may have any shape and may in particular have a shape so that the small diameter portion of the article that extends through the through-hole establishes a form-fit (i.e. positive fit) with the through-hole 51. Instead of a positive fit, the through-hole may just be elongated instead of circular. In both cases, positive fit or elongated shape, the shape of the through-hole 51 may essentially inhibit a rotation of the article when the folded box 1 is carried around.

As will be explained in more detail with respect to FIGS. 2A-2D, the separation wall may be one-layered or multi-layered.

A flap element 60 is arranged at the open end 5 of the box 1. The flap element 60 comprises a first flap portion 61 that is aligned with the left side wall 20 and a second flap portion 63 that is aligned with the bottom wall 40. The flap element 60 can be flapped from the shown first state in which the first and second flap portions 61, 63 are aligned with their respective walls into a second state in which the first and second flap portions 61, 63 project inside into the first interior box section 3 as will be explained in more detail with respect to FIGS. 3A, 3B, 4A, and 4B.

The first flap portion 61 is connected with the left side wall 20 along a weakened line 62 (e.g. a stamped line) and the second flap portion 63 is connected with the bottom wall 40 along a weakened line 64 (e.g. a stamped line). The first flap portion 61 may be separated from the left side wall 20 along a cut line 65 (alternatively, line 65 may be a perforated line that easily separates from the side wall 20 when a force acts on the flap element 60 to flap it from its first state into the second state) and the second flap portion 63 may be separated from the left side wall 20 along a cut line 66 (alternatively, line 66 may be a perforated line that easily separates from the bottom wall 40 when a force acts on the flap element 60 to flap it from its first state into the second state).

The first flap portion 61 and the second flap portion 63 are connected along a weakened line 67. The weakened lines 62, 64, and 67 have the function of hinges allowing the flap element 60 to flap from its first state as shown into the second state. Once an article is received in the box interior 2, the flap element 60 may be flapped from the first state into the second state so that the article is secured inside of the box interior 2. The separation wall 50 provides then one confining surface and the flap element 60 provides in the second state another confining element. The length of the free length of the first interior box section 2 may be dimensioned so that the large diameter portion of the article precisely fits into it.

In the shown embodiment, the box 1 comprises an elongated window 70 in the top wall element 10. The window 70 allows access into the first interior box section 3, e.g. a robot gripper arm may enter into the first interior box section 3 to handle an article when the article is automatically disposed in the box 1. It is indicated by dashed lines that the window 70 may extend into the side walls 20 and/or 30 so that the window would have side portions 61A and/or 61B.

FIGS. 2A to 2D are cross sectional depictions of the back portion of exemplary embodiments of boxes where the separation walls are realized in four different manners.

Figure 2A:
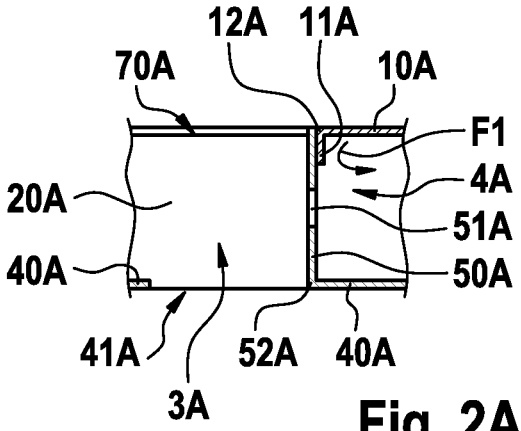
FIGS. 2A-2D are schematic cross-sectional images of four exemplary embodiments of the cardboard box, showing different realizations of the separation wall.

In FIG. 2A is a portion of a cross-sectional depiction of a first exemplary embodiment of the box 1. The box has a top wall element 10A, a bottom wall element 40A, a side wall element 20A, and a separation wall 50A including a through hole 51A therein. The separation wall 50A is connected to the bottom wall element 40A along a weakened line 52A and is folded around that weakened line 52A into a position at which it projects upwards at an angle of about 90 degrees with respect to the bottom wall element 40A. A lid 11A is realized at the top wall element 10A and is folded around a weakened line 12A so that it projects downwards at an angle of about 90 degrees with respect to the top wall element 10A. The lid 11A is provided at a longitudinal position so that the separation wall 50A could be connected with, in particular glued to the lid 11A and the about 90 degrees upward projection angle could be achieved.

Figure 2B:
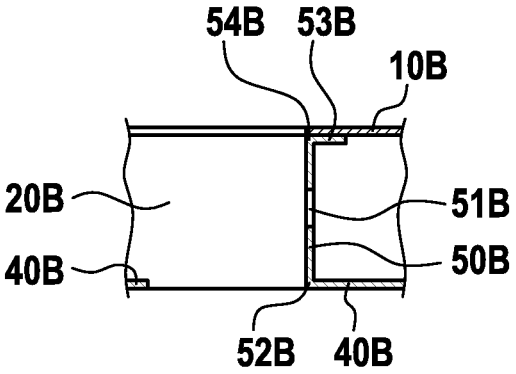

In FIG. 2B is a portion of a cross-sectional depiction of a second exemplary embodiment of the box 1. The box has a top wall element 10B, a bottom wall element 40B, a side wall element 20B and a separation wall 50B having a through hole 51B therein. The structural design of the second exemplary embodiment is very similar to the first exemplary embodiment, but the difference is that the separation wall 50B has a lid 53B has is provided at the end of the separation wall 50B and is connected to the separation wall along a weakened line MB, around which the lid is bent so that it projects horizontally away from the separation wall 50B at an angle of about 90 degrees with respect to the separation wall 50B. The lid 52B is connected with, in particular glued to the inner surface of the top wall element 10B.

Figure 2C:
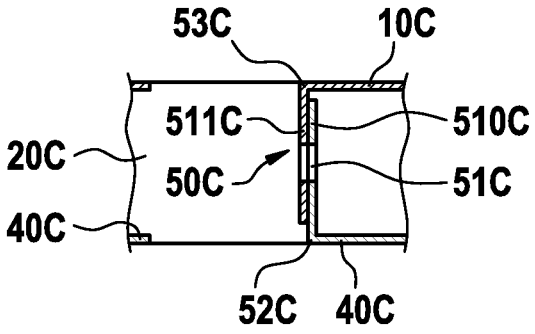

In FIG. 2C is a portion of a cross-sectional depiction of another exemplary embodiment of the box 1, having a top wall element 10C, a bottom wall element 40C, a side wall element 20C, and a separation wall 50C having a through hole 51C therein. In this embodiment, the separation wall 50C comprises two cardboard layers 510C and 511C. The inner cardboard layer 510C is connected with the bottom wall element 40C along a weakened line 52C and is bent into an upwards projecting position having an angle of about 90 degrees with respect to the bottom wall element 40C. The outer cardboard layer 511C of the separation wall 50C is connected with the top wall element 10C along a weakened line 53C and is bent into a downwards projecting position having an angle of about 90 degrees with respect to the top wall element 10C.

The two cardboard layers 510C and 511C are connected with each other and may in particular be glued to each other. The through-holes in the individual cardboard layers of the separation wall 50C are aligned with each other to form the through-hole 51C. The larger the width of the through-hole 51C in longitudinal direction, the better is the structural integrity of the through-hole 51C acting against any possible rotation of the small-diameter portion of the article once disposed in the box.

Figure 2D:
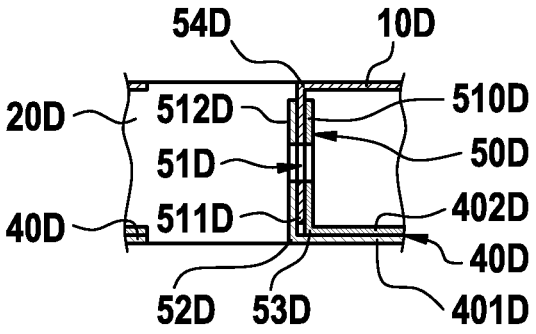

In FIG. 2D, showing a portion of a cross-sectional depiction of another exemplary embodiment of the box 1, there are shown a top wall element 10D, a bottom wall element 40D, a side wall element 20D, and a separation wall 50D having a through hole 51D therein. In this embodiment, the bottom wall element 40D comprises two cardboard layers 401D and 402D and the separation wall 50D comprises three cardboard layers 510D, 511D, and 512D.

The outer cardboard layer 512D of the separation wall 50D is connected with the outer cardboard layer 401D of the bottom wall element 40D along a weakened line 52D and is bent into an upwards projecting position having an angle of about 90 degrees with respect to the bottom wall element 40D. The inner cardboard layer 510D of the separation wall 50D is connected with the inner cardboard layer 402D of the bottom wall element 40D along a weakened line 53D and is bent into an upwards projecting position having an angle of about 90 degrees with respect to the bottom wall element 40D. The middle cardboard layer 511D of the separation wall 50D is connected with the top wall element 10D along a weakened line 54D and is bent into a downwards projecting position having an angle of about 90 degrees with respect to the top wall element 10D. The layers 510D, 511D, and 512D of the separation wall 50D are connected with each other and in particular they are glued to each other.

As already mentioned, the separation wall works as an abutment surface against which an article disposed in the box interior can abut and the through-hole in the separation wall may additionally provide a rotation stop. The inherent elasticity of the separation wall works to absorb energy during a drop or other impact and thus keeps the article safe. The stronger the separation wall (e.g. due to a multi-layered structure) the better is the separation wall protected against rupture during such a mentioned drop or other impact.

These exemplary embodiments should not be considered as exhaustive. In particular, in some embodiments, the top wall element is two-layered, or both the top wall element and the bottom wall element are two-layered, and the separation wall may then be four-layered. In some embodiments, the through-hole in the separation wall may change is shape and/or size to optimize the intended positive fit with a short-diameter portion of an article to be received in the box.

Figure 3B:
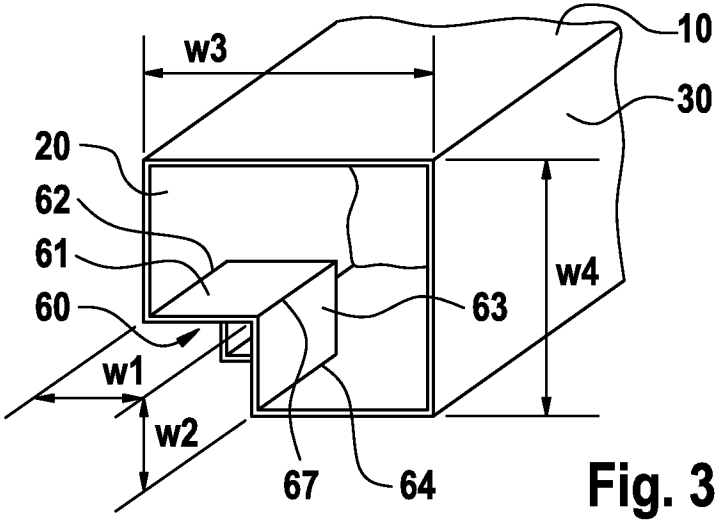
FIGS. 3A, 3B are schematic depictions of an open end of an exemplary embodiment of the cardboard box, comprising a flap portion that has two folding states.
Figure 3A:
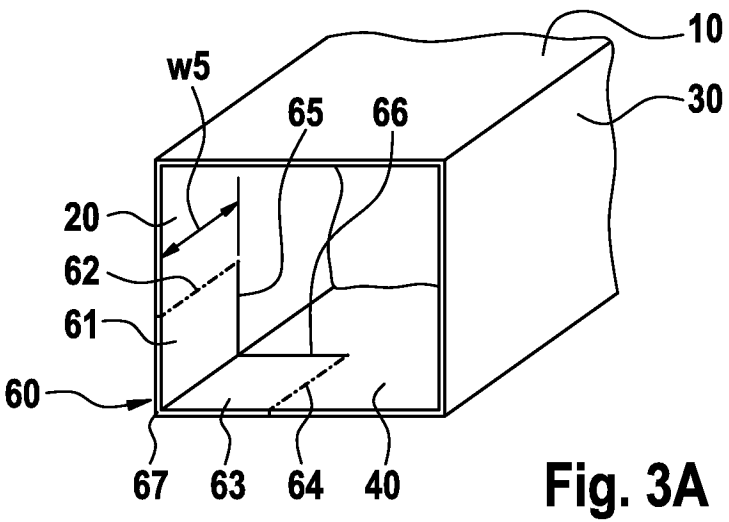

FIGS. 3A and 3B are magnified depictions of the open end of the box 1 shown in FIG. 1, where FIG. 3A is just a magnification and FIG. 3B shows the flap element 60 in its flapped state, i.e. in the second state. For sake of completeness, it is mentioned that the box has four longitudinal wall elements 10, 20, 30, and 40 that together enclose an interior of the box.

At an open end of the box a flap element 60 is provided that comprises a first and a second flap section 61 and 63, which are each connected to their wall element by means of a weakened line 62 and 64, respectively. The first and second flap portions 61 and 63 are connected to each other along a weakened line 67. The flap element is separated from the wall elements 20 and 40 by means of separation lines 65 and 66.

FIG. 3B is a depiction of the same open end of the box as shown in FIG. 3A but where the flap element 60 is shown in its flapped state (the second state). Due to the chosen geometry, the first flap portion 61 is bent around weakened line 62 so that it now projects inwards with an angle of about 90 degrees with respect to the left side wall 20 and the second flap portion 63 projects upwards into the box interior with an angle of about 90 degrees with respect to the bottom wall element 40. The first and the second wall element adjoin each other at weakened line 67 at an angle of about 90 degrees. In the second state as shown in FIG. 3A, the flap element 60 efficiently secures an article having a diameter close to or about the size of the box interior inside of the box. The relatively high rigidity of the flap element 60 in longitudinal direction and additionally its inherent elasticity serves to keep the article safely inside of the box even under drops or other impacts.

The width of the rectangular box is w3, and its height is w4. In the shown example, the height w4 of the box is somewhat larger than the width w3 of the box, but w3 may also be equal to w4 or w3 may be larger than w4. The lengths of the flap portions 61 and 63 are, respectively, w1 and w2, where w1 can be equal to w2. In the shown example, the length w2 of the second flap portion is about w3/2, i.e. the length w2 of the flap portion 63 realized at the shorter width wall element 40 is chosen to be about half of the width w3 of the respective wall element 40.

Figure 4B:
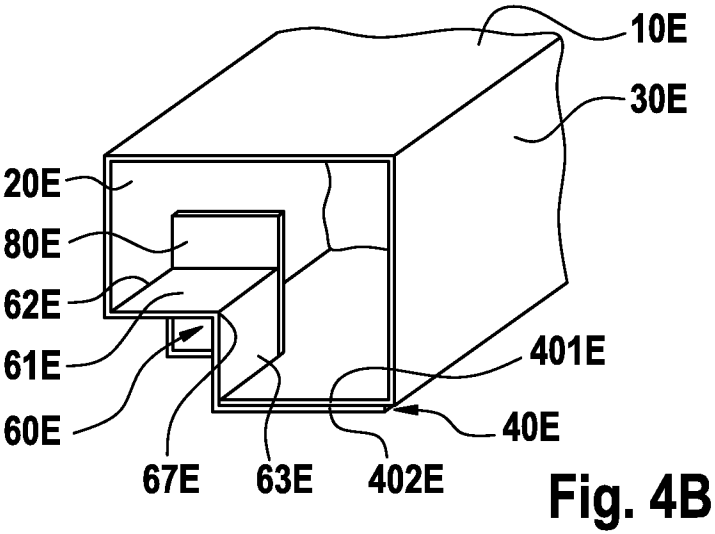
FIGS. 4A, 4B are schematic depictions of an open end of an exemplary embodiment of the cardboard box, comprising a flap portion that can be folded into at least one of two states and a wall portion that is folded upwards when the flap portion is folded inwards.
Figure 4A:
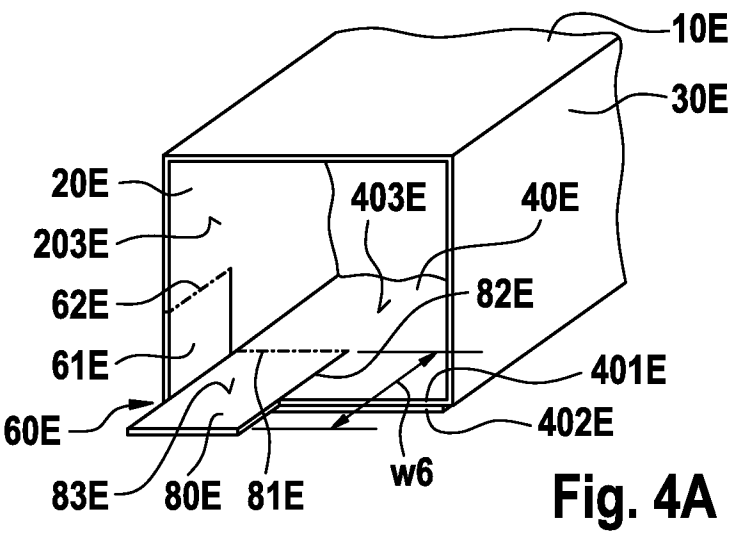

FIGS. 4A and 4B show another exemplary embodiment of an open end of the box in accordance with the present description. In the shown embodiment, the box has four wall elements: 10E, 20E, 30E, and 40E. The bottom wall element 40E is a two-layered wall element having an inner cardboard layer 401E and an outer cardboard layer 402E. The inner cardboard layer 401E ends shortly before the left side wall element 20E does.

A flap element 60E is provided in the left side wall element 20E and the lower layer 402E of the bottom wall element 402E. In the inner cardboard layer 401E of the bottom wall element 40E, a wall element 80E is provided. The wall element 80E extends in longitudinal direction and is connected with the inner cardboard layer 401E along a weakened line 81E. The wall element has a separation line 82E along which it is separated from the inner cardboard layer 401E. The separation line 82E can be either a cut line or a perforated line that allows easy separation from the cardboard layer 401E when a separation force acts on the separation line 82E. The length w6 of the wall element 80E in the longitudinal direction is chosen such that the wall element projects beyond the bottom wall element 40D.

FIG. 4B shows the same end of the box as is shown in FIG. 4A, but with the flap element 60E in its second state (the flapped state). Here, the flap element 60E has about the same geometry as it does in FIGS. 3A and 3B, and it is thus referred to the description of FIG. 3B. When the flap element 60E is flapped into its second state, the movement of the flap portions 61E and 63E have also moved the wall element into its shown position, where the wall element 80E projects upwards from the inner cardboard layer 401D at an angle of about 90 degrees with respect to the bottom wall element 40D. In this state, the wall element 80E is arranged between an article that may be disposed in the box interior and the flap element 60E.

The present arrangement of flap element 60E and wall element 80E can provides a higher stability than does the flap element 60 shown in FIGS. 3A and 3B. The wall element 80E also protects the article inside the box interior from sharp edges of the cut or perforated sides of the flap portions 61E and 63E. This is particularly beneficial where the article has an outer surface that can be scratched by the edges of a cut cardboard layer. In order to enhance this effect, the inner surface side 83E of the wall element 80E may be lacquered to provide a low-scratchiness surface.

As a matter of fact, and generally applicable to all embodiments discussed herein, the inner surfaces of the box, such e.g., as the inner surface 203E of the left side wall element 20E or the inner surface 403E of the inner cardboard layer 401E, may be lacquered or coated to provide a low-scratchiness surface to protect an article disposed in the box from receiving scratches. Scratches can be effectively avoided if the lacquer has a relatively low static coefficient of friction (COF) of about below 0.3, e.g. where the static COF is in the range of between 0.1 and 0.3. This may be achieved by applying a lacquer layer having a specific area weight in the range of between 4 $g/m^2$ and 12 $g/m^2$.

Figure 5:
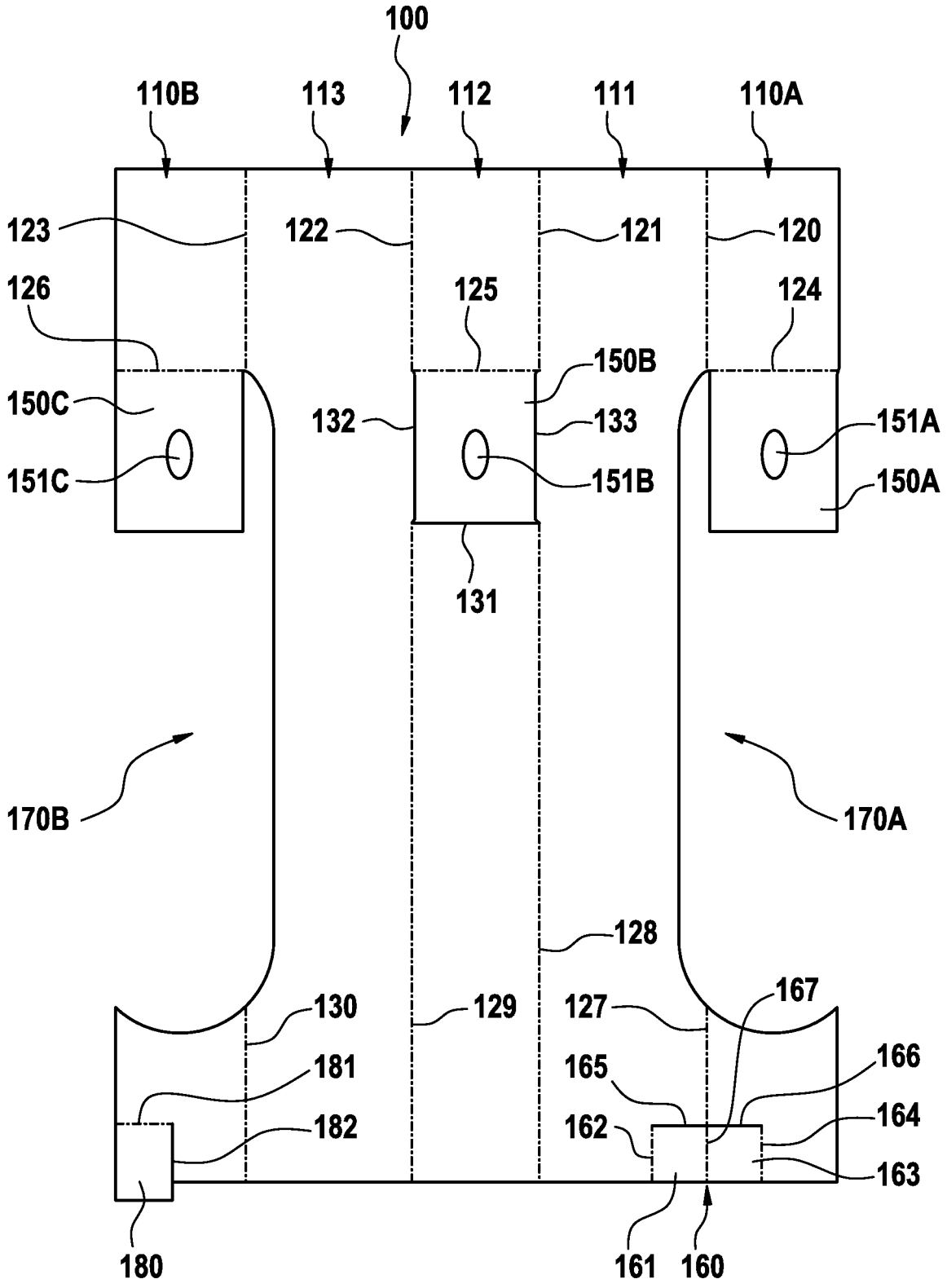
FIG. 5 is a schematic depiction of an exemplary embodiment of the cardboard blank for making the cardboard box in accordance with the present description.

FIG. 5 is a depiction of an exemplary flat cardboard blank 100, which can be made from a flat piece of cardboard by means of cutting and/or stamping, as is generally known in the art. The cardboard blank 100 can be folded into a folded cardboard box as discussed in previous paragraphs. No further elements are necessary for making a folded cardboard box in accordance with the present disclosure. The cardboard blank may be provided with glue at certain positions so that the folded cardboard box will become fixed in its folded shape. The application of glue is a standard procedure and is not further discussed.

The cardboard blank comprises wall elements 110A, 110B, 111, 112, and 113 that will form the longitudinal wall elements of the final folded cardboard box, where the blank is cut so that the top wall element of the folded cardboard box will be two-layered, where wall element 110A and 110B will form the final top wall element. With reference to FIG. 1, the wall element 111 will form the left-side wall element, wall element 112 will form the bottom wall element and wall element 113 will form the right-side wall element.

The cardboard blank 100 comprises three separation wall elements 150A, 150B, and 150C, that together will form the separation wall. Each of the separation wall elements 150A, 150B, 150C has a respective through-hole 151A, 151B, and 151C that align with each other when the cardboard blank is folded into its box shape. As can here be seen, the through-holes 151A, 151B, 151C have an elongated, elliptical shape that will inhibit the rotation of a similarly shaped portion of an article that will extend through the aligned through-holes. The through-holes 151A, 151B, 151C may in particular be shape so that a positive fit is achieved between the through-hole and the respective portion of the article extending therethrough.

The cardboard blank 100 comprises a flap element 160 and a wall portion 180, which have been described in previous paragraphs, in particular with reference to FIGS. 4A and 4B. The cardboard blank 100 also comprises cut-outs 170A and 170B that together will form a window in the top wall element, which window will extend into the two side wall elements. In order to allow the cardboard box to become folded in the intended manner, the cardboard blank comprises weakened lines 120, 121, 122, 123, 124, 125, 126, 127, 128, 129, 130, 162, 164, and 182 and further comprises cut lines 131, 132, 133, 165, 166, and 182.

Figure 6:
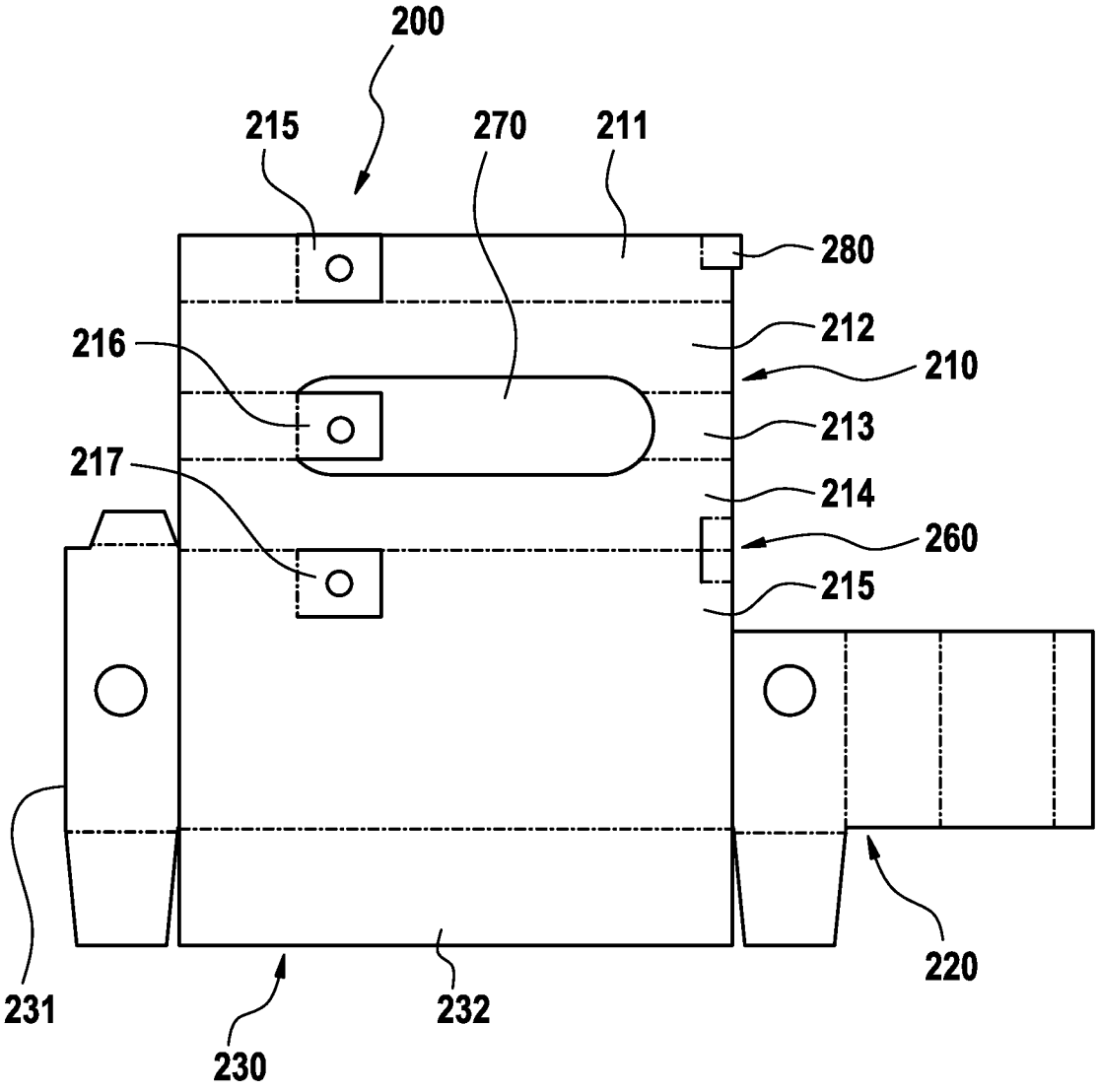
FIG. 6 is a schematic depiction of another exemplary embodiment of the cardboard blank for making the cardboard box in accordance with the present description.

FIG. 6 shows a depiction of another exemplary cardboard blank 200, which cardboard blank can be folded into the folded cardboard box in accordance with the present description. The cardboard box comprises three sections, namely a first section 210 that relates to a four-walled box having a separation wall as discussed in previous paragraphs and a second section 220 and a third section 230 that relate to further compartments of the folded cardboard box. As described already with reference to the cardboard blank shown in FIG. 5, the box portion for receiving an article comprises again wall elements 211, 212, 213, 214, and 215, where wall element 215 forms the bottom wall of the box for receiving an article, but wall element 215 is larger in its extension and will also form the bottom wall of a larger split compartment.

As previously discussed, the cardboard blank 200 comprises separation wall elements 215, 216, and 217, a flap element 260, a cut-out window 270, and a wall portion 280. The second section 220 of the cardboard blank 200 can be folded together to form an essentially closed compartment that may receive some accessory for the article, e.g. the article may be an electric toothbrush handle and the accessory may then be a charger for the electric toothbrush handle. The third section 230 can be folded together to essentially form an open tray that may receive, e.g. a user brochure. While two sides of the resulting open tray will be defined by the boxes resulting from sections 210 and 220, section 230 comprises side wall elements 231 and 232 that will define the other two sides of the open tray. The cardboard blank may comprise areas of applied glue that may be provided on the cardboard blank 200 to securely hold together the elements of the resulting folded cardboard box.

Figure 7:
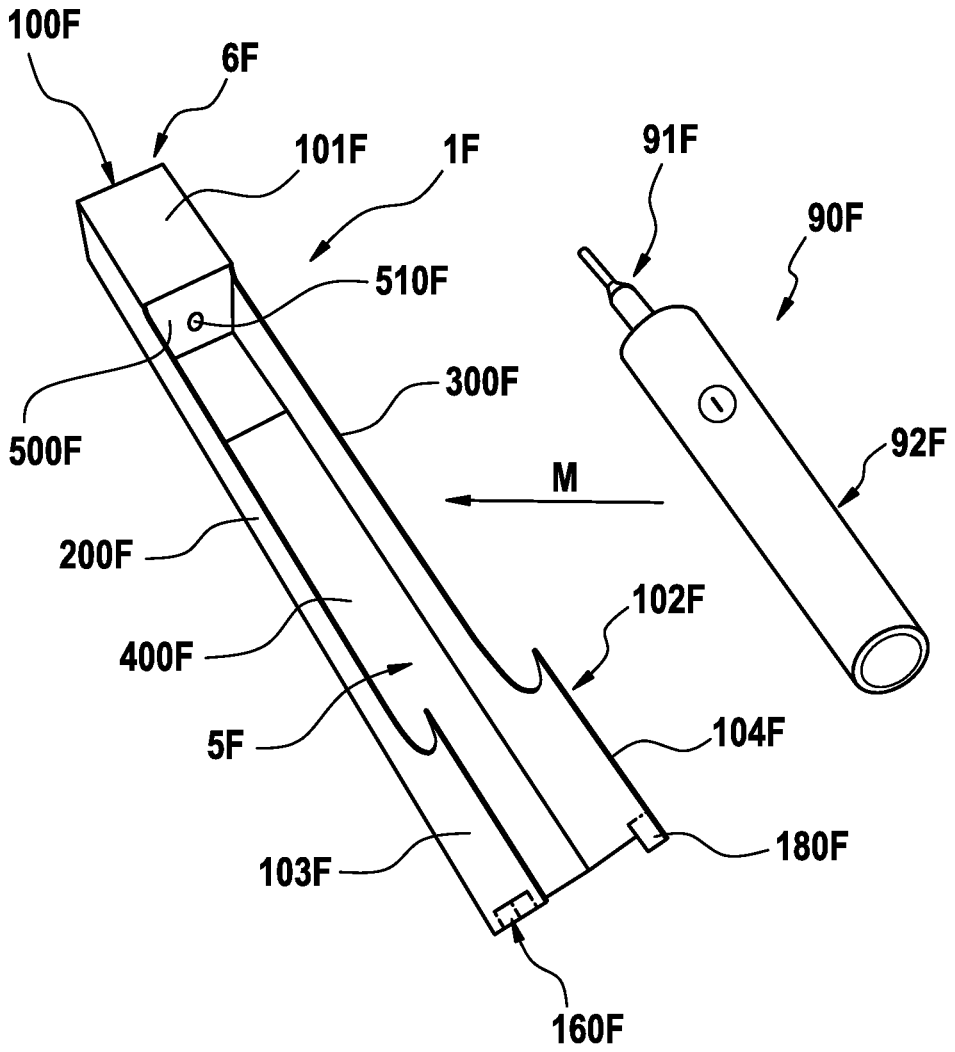
FIG. 7 is a schematic depiction of an intermediate step in an exemplary method of packing a toothbrush into the folded cardboard box.

FIG. 7 shows an almost complete folded cardboard box IF, which may be made from a cardboard blank 100 as shown in FIG. 5. The almost completely folded cardboard box comprises four longitudinal wall elements 100F, 200F, 300F, and 400F, where wall element 100F is realized as a two-layered wall element, but where only a portion 101F of the top wall element 100F is already folded and glued together, while another portion 102F that will be formed by partial wall elements 103F and 104F is still in an unfolded (i.e. open) state. The folded cardboard box 1F comprises a separation wall 500F having a through-hole 510F and further, as already discussed, a flap portion 160F and a wall portion 180F. In addition, an article 90F is shown, which is here a handle of an electric toothbrush, which article 90F has a front portion 91F that has a small diameter/cross section and a grip portion 92F having a larger diameter/cross-section.

In an automated assembly process, a robot may grip the article 90F and may move it along a preprogrammed path M into the partially open folded cardboard box 1F so that the front portion 91F will extend through the through-hole 510F and extends into the second interior box section 6F and the grip portion 92F is disposed in the first interior box section 5F. After this step of positioning the article 90F in the still partially open folded cardboard box 1F, the partial wall portions 103F and 104F are folded and glued together to form the complete folded cardboard box 1F (partial wall element 103F will form the outer cardboard layer and partial wall element 104F the inner cardboard layer). In a further, in particular automated step, the flap portion 160F is folded inwards and thus folds the wall portion 180F downwards. The article 90F is then completely received in the folded cardboard box 1F and can be transported further along without the risk that the article 90F slides out of the box interior.

FIGS. 8A to 8D show steps or stages of closing another embodiment of a cardboard box 1G. The cardboard box 1G may be made from a single cardboard blank as is shown in FIG. 5, where in particular the wall portion 80G is here differently realized, but the cardboard box 1G may also be made from two or more separate pieces of cardboard. The cardboard box 1G comprises four longitudinally extending wall elements 10G, 20G, 30G, and 40G. The top wall element 10G may be realized as a double cardboard-layer wall element. But it shall be understood that the double-layer design may not encompass the complete top wall element 10G but may be limited to the rear end portion 112G of the top wall element 10G. The front-end portion 111G of the top wall element 10G may have a single cardboard-layer design. This holds in general for all embodiments discussed herein and not just for the cardboard box 1G of FIGS. 8A to 8D.

The top wall element 10G comprises a window 70G that allows access to the first interior box section 3G. In the process of closing the cardboard box 1G, an article may be inserted into the elongated interior of the cardboard box (e.g. between the states shown in FIG. 8A and FIG. 8B, an article may be inserted into the elongated interior), but it has been omitted to show this in the figures for sake of focusing on the closing steps.

Figures 8A, 8B, 8C, 8D:
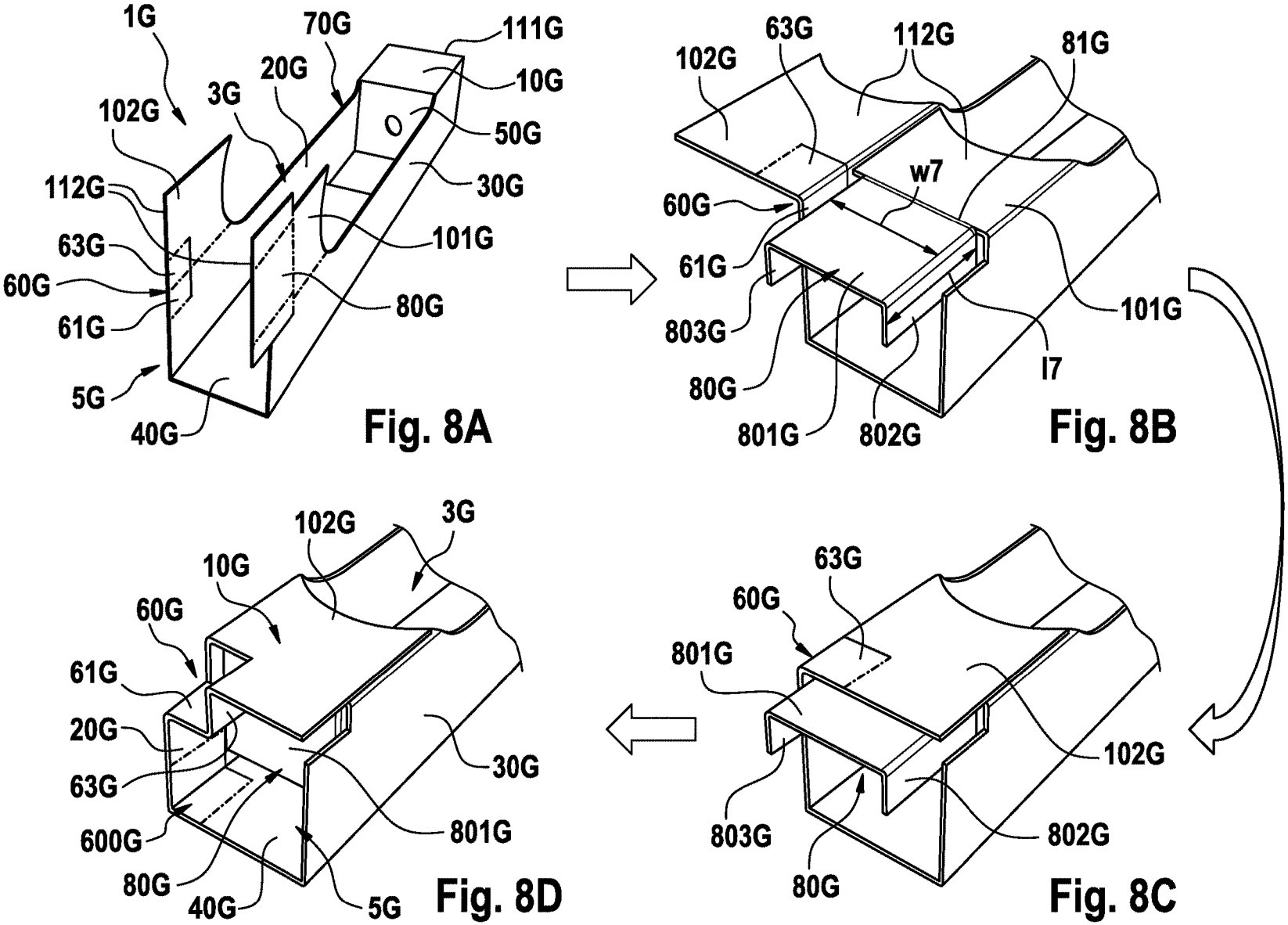
FIGS. 8A-8D schematically show four stages of closing an exemplary embodiment of the cardboard box.

In FIG. 8A, the cardboard box 1G is shown in an open state in which the top wall element 10G is still open at the rear open end 5G. The rear end portion 112G of the top wall element 10G comprises an inner cardboard layer 101G at which a wall element 80G is realized and an outer cardboard layer 102G that comprises a flap portion 63G of a flap element 60G.

FIG. 8B shows a second stage of the process of closing the cardboard box 1G, where the inner cardboard layer 101G is folded inwards to partially cover the first interior box section 3G. The wall portion 80G comprises a center portion 801G and two flap portions 802G and 803G that are arranged at opposite sides of the center portion 801G. The flap portions 802G and 803G are here shown in an already flapped state in which they extend about perpendicularly away from the center portion 801G.

The wall element 80G is separated from the inner cardboard layer 101G by means of a weakened line 81G that allows inwards bending of the wall portion 80G. The center portion 801G has a width w7 that is somewhat smaller than the free inner width of the top wall element 10G. Depending on the size of the article to be received in the cardboard box, the width w7 may be adapted, e.g. the width w7 may be set to match or be slightly larger than the respective width of the article. The wall portion 80G has a length l7 that may be close to the inner free height of the cardboard box 1G.

FIG. 8C shows a third stage of closing the cardboard box 1G, where the outer cardboard layer 102G is folded on top of the inner cardboard layer 101G and the two cardboard layers may then be connected, e.g. by means of an adhesive (of course, the wall portion 80G is not glued to the outer cardboard layer 102G).

FIG. 8D shows the final state of closing the cardboard box 1G, where the flap element 60G is flapped from its unflapped first state into its flapped second state and the wall portion 80G is bent inwards so that it now extends about perpendicularly from the top wall element 10G into the first interior box section 3G. While flapping the flap element 60G and bending the wall portion 80G may be independent steps, the wall portion 80G may in particular be bent as a consequence of the step of folding the flap element 60G. E.g. a pusher element of a closing machine may act against one of the flap portions 61G, 63G of the flap element 60G to flap the flap element 60G from its first state into its second state. By such a folding action, the underlying wall portion 80G may become folded from its first state into its second state as well due to a force applied by the flap element 60G acting on the wall portion 80G.

But this shall not exclude embodiments where an alternative flap element 600G is present that is realized at a different corner of the open rear end 5G of the cardboard box 1G, e.g. the alternative flap element 600G may be provided at the bottom wall element 40G and at the side wall element 20G. In order to close the cardboard box 1G, the wall portion 80G may then first be folded into its second state and then the flap element 600G may be flapped into its second state.

In some embodiments, two or more flap elements 60G and 600G are provided to keep the wall portion 80G in its second state.

As previously discussed in connection with FIG. 8B, the width w7 of the wall portion may be adapted to the size of the article to be received in the box interior (obviously, it is referred to the size of the rear end of the article that will abut against the center portion 801G of the wall portion 80G) so that the flap portions 802G and 803G reduce or inhibit lateral movement of the article inside of the cardboard box 1G. As the width w7 can be adapted, cardboard boxes having identical outer geometries can be used to hold articles of various sizes, which allows using the same assembly line for packing differently sized articles, e.g. electric toothbrushes having different bottom diameters. The flap portions 802G and 803G may not necessarily stay in the perpendicular orientation as shown, but they may be pushed against the side wall elements 20G and 30G, but the width w7 is not affected and the wall portion 80G will still provide its intended confinement function.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm."

Every document cited herein, including any cross referenced or related patent or application and any patent application or patent to which this application claims priority or benefit thereof, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A folded cardboard box for receiving an electric toothbrush comprising a grip portion having a relatively large cross-section and a front portion having a relatively small cross-section, the box having a longitudinal direction and comprising:

four longitudinal wall elements surrounding an essentially rectangular elongated interior;

a separation wall comprising a through-hole and dividing the elongated interior in the longitudinal direction into a first interior section and a second interior section, wherein the through-hole is structured and configured to accept the front portion of the electric toothbrush, so that when the toothbrush is disposed in the cardboard box, the front portion extends through the through-hole;

a flap element located at an open end of the first interior section and having a first flap portion provided at one of the longitudinal wall elements and a second flap portion provided at an adjoining longitudinal wall element, wherein the flap element is structured and configured to be flapped from a first state in which each of the first and second flap portions are aligned with the respective wall element at which they are provided into a second state in which the flap element projects into the first interior section, a longitudinally extending wall portion provided at one of the longitudinal wall elements at the open end of the first interior section that is at its rear end connected to the longitudinal wall element at which it is provided by means of a seam line that allows bending of the wall portion from a first state in which it essentially extends in longitudinal direction into a second state in which the wall portion projects from the longitudinal wall element at which it is provided at about a right angle into the first interior section, and wherein the flap element when in its second state keeps the wall portion in its second state.

2. The box of claim 1, wherein the wall portion comprises a center portion and at least one flap portion extending sidewards and separated by a bending line from the center portion allowing to bend the flap portion inwards so that when the wall portion is in its second state, the at least one flap portion extends into the elongated interior where the wall portion has two flap portions extending sidewards and arranged at opposite sides of the center portion.

3. The box of claim 1, wherein at least one of the longitudinal wall elements is made from at least two layers of cardboard.

4. The box of claim 3, wherein at least one of the first and second flap portions of the flap element is provided at an outer cardboard layer of longitudinal wall element made from two cardboard layers, and the wall portion is provided at an inner cardboard layer of the longitudinal wall element made from two cardboard layers.

5. The box of claim 4, wherein a longitudinal width of the wall portion is about a width of the first flap portion or the second flap portion realized at an outer cardboard layer of the two-layered wall element.

6. The box of claim 1, wherein the longitudinally extending wall portion is separated, in the longitudinal direction, from the longitudinal wall element at which it is provided or is connected to the longitudinal wall element by means of a perforated line.

7. The box of claim 1, wherein the separation wall comprises a first separation wall element that is connected with one of the wall elements along a seam line and a second separation wall element that is connected with a wall element opposite to the wall element at which the first separation wall element is provided and where the first separation wall element is joint with the second separation wall element to form the separation wall.

8. The box of claim 7, wherein at least one of the wall elements at which one of the first and second separation wall elements are provided is at least a two-layer cardboard wall element and wherein at least a third separation wall element is provided at one of the layers of the wall element that is two-layered and wherein the third separation wall element is joined with at least one of the first separation wall element and the second separation wall element to form the separation wall.

9. The box of claim 1, wherein the separation wall comprises at least a first separation wall element that is joint with a wall element that is opposite to the wall element at which the first separation wall element is provided by means of a lid element provided either at the end of the first separation wall element or at the opposite wall element.

10. The box of claim 1, wherein a top wall element comprises a window allowing access into the first interior section.

11. The box of claim 1, wherein the box is made solely from a single cardboard blank.

12. The box of claim 1, wherein the box has a low surface roughness coating at least on the surfaces defining the first interior section.

13. The box of claim 12, wherein an arithmetic mean deviation of an assessed surface profile is less than or equal to 5 micrometers (Ra≤5 μm).

14. A method of automated packaging an electric toothbrush into a cardboard box, the method comprising the steps of:

providing a cardboard box of claim 1, where the flap element is in its unflapped state;

providing the toothbrush comprising a first portion having a first diameter fitting into the first interior section and a second portion having a second diameter that is smaller than the first diameter;

inserting the toothbrush into the first interior section until the second portion of the toothbrush extends through the trough-hole in the separation wall and the first portion abuts the separation wall;

bending the wall portion from its first state into its second state so that the wall portion projects from the longitudinal wall element at which it is provided at about a right angle; and flapping the flap element from its first state into its second state so that the wall portion becomes arranged between an end of the toothbrush and the flap element, thereby securing the toothbrush inside the cardboard box.

15. The method of claim 14, wherein the step of bending the wall portion and the step of flapping the flap element are performed simultaneously.

16. The method of claim 15, wherein bending the wall portion is caused by flapping the flap element.

17. The method of claim 14, wherein the cardboard box is provided in an almost completely folded state in which at least one wall element covering the first interior section is not closed and wherein the toothbrush is first inserted into the first interior section until the second portion of the toothbrush extends through the trough-hole in the separation wall and the first portion abuts the separation wall, and then the open wall element is closed.

* * * * *